US005555493A

United States Patent [19]

Amblard et al.

[11] Patent Number: 5,555,493

[45] Date of Patent: Sep. 10, 1996

[54] FLUID OPTICS PROJECTOR

[76] Inventors: Jean-Claude Amblard; Amilcar Vide-Amblard, both of 4, rue du Vert-Bois, F-75003 Paris; Roger Le Nagard, 1, rue de la Vielle-Butte, F-78100 S.-Germain-en-Laye; Jean Georget, 20, rue Jean Moulin, F-94300 Vincennes, all of France

[21] Appl. No.: 157,205

[22] PCT Filed: Mar. 30, 1993

[86] PCT No.: PCT/FR93/00314

§ 371 Date: Dec. 13, 1993

§ 102(e) Date: Dec. 13, 1993

[87] PCT Pub. No.: WO93/21474

PCT Pub. Date: Oct. 28, 1993

[30] Foreign Application Priority Data

Apr. 13, 1992 [FR] France ..... 92 04509

[51] Int. Cl.[6] ..... F21V 29/00

[52] U.S. Cl. ..... 362/318; 362/294; 362/350; 362/373; 362/307; 313/32; 313/36; 359/665

[58] Field of Search ..... 313/24, 32, 44, 313/293, 45, 112, 113, 634, 12, 35, 36; 165/104.33; 362/293, 373, 318, 304, 264, 294, 345, 347, 350, 218, 348; 359/665, 666

[56] References Cited

U.S. PATENT DOCUMENTS

| | | | |
|---|---|---|---|
| 2,195,392 | 3/1940 | Alphen | 362/264 |
| 2,520,691 | 8/1950 | Otis | 362/318 X |
| 3,319,097 | 5/1967 | Giannini et al. | 313/12 |
| 3,371,202 | 2/1968 | Moore et al. | 362/304 X |
| 3,628,601 | 12/1971 | Snaper | 362/345 X |
| 3,825,741 | 7/1974 | Morton et al. | 362/218 |
| 3,914,010 | 1/1975 | Zeller | 359/665 X |
| 3,941,451 | 3/1976 | Humphrey | 359/665 X |
| 4,388,678 | 6/1983 | Turner | 362/345 X |
| 4,509,104 | 4/1985 | Suzuki et al. | 362/264 X |
| 4,576,436 | 3/1986 | Daniel | 359/591 X |
| 4,631,642 | 12/1986 | Brun | 362/32 |
| 4,709,312 | 11/1987 | Heinisch et al. | 362/346 X |
| 4,785,216 | 11/1988 | Roberts et al. | 362/36 X |

*Primary Examiner*—Denise L. Gromada
*Assistant Examiner*—Thomas M. Sember
*Attorney, Agent, or Firm*—Sughrue, Mion, Zinn, Macpeak & Seas

[57] ABSTRACT

A fluid optical system for focusing all entering light whatever its direction and incidence, and having an entrance surface through which the light enters. The optical system has a volume having an optical shape generated by a logarithmic spiral so that the focusing occurs for light beams entering the entrance surface from any direction through any point of the entrance surface. There flows in the optical shape a fluid which is maintained in forced circulation to form a fluid optical system, and which is forced to enter the optical system tangentially to the optical shape and adjacent to the entrance surface which is arranged so that initial circulation is tangential and laminar. Inside the optical system, the fluid has a centripetal rotation movement until it exits through a cone end of the optical shape, thus draining off calories.

5 Claims, 2 Drawing Sheets

FLUID OPTICS PROJECTOR

BACKGROUND OF THE INVENTION

The present invention deals with very powerful industrial optical systems. It concerns the creation of a floodlight much brighter than any other existing light.

SUMMARY OF THE INVENTION

With such a system, there is no need for anticaloric glass to project either fixed or moving pictures, hence a considerably better optical efficiency. Existing floodlights are traditionally made of a lightsource, a reflector and an external Fresnel lens. Their power is limited to 20 Kw and requires the use of anticaloric glass. This is detrimental to the brightness necessary for the projection of fixed images. The invention overcomes this drawback. The invention uses the optical and thermic properties of fluid elements. These elements may be in a stable state, or set in motion by natural convection, or maintained in forced motion in a carefully designed container with an appropriate internal optical shape.

The variation of the refraction rate, forced and maintained by the control of the fluid environment's thermic gradient, is used to create a refraction rate gradient. Moreover, the fluid's ability to transmit or absorb part of the luminous flow depends on the wavelength. The optical system collects all the light produced by one or several light sources such as the lamp 20, whatever the incidence of the entering light radiation and its position relative to the entrance surface. The system then focuses the light and concentrates it into a divergent set of beams with a constant shape. Using the Descartes-Snell's laws, the properties of refraction and total reflection are verified on the optical system's surfaces and diopters and also within the moving fluid. It is worth noting that the optical system is thermically controlled by forced movements of gaseous or liquid fluids.

This new system avoids the use of anticaloric filters which limit existing projectors of fixed images (25 to 30% output). Such filters absorb a great deal of visible light.

The adopted solution consists of circulating a fluid, which is transparent to visible light and opaque to other light rays, inside a container. This container shall be appropriately shaped, so that Descartes-Snell's laws are confirmed and subject to a laminated circulation. Such circulation creates a regulated thermic gradient inside the container, thus enabling the concentration of light rays by successive reflections and refractions. The shape of the concentrating optical system's volume is obtained by the revolution of a segment of an arc of a logarithmic spiral. One any use other kinds of arc segments, curves or broken line approximations to create this shape, but the arc of a logarithmic spiral is the only one which produces the maximum optical output. There are also other possibilities than shapes generated by revolution.

DESCRIPTION OF A PREFERRED EMBODIMENT

Figure 1:
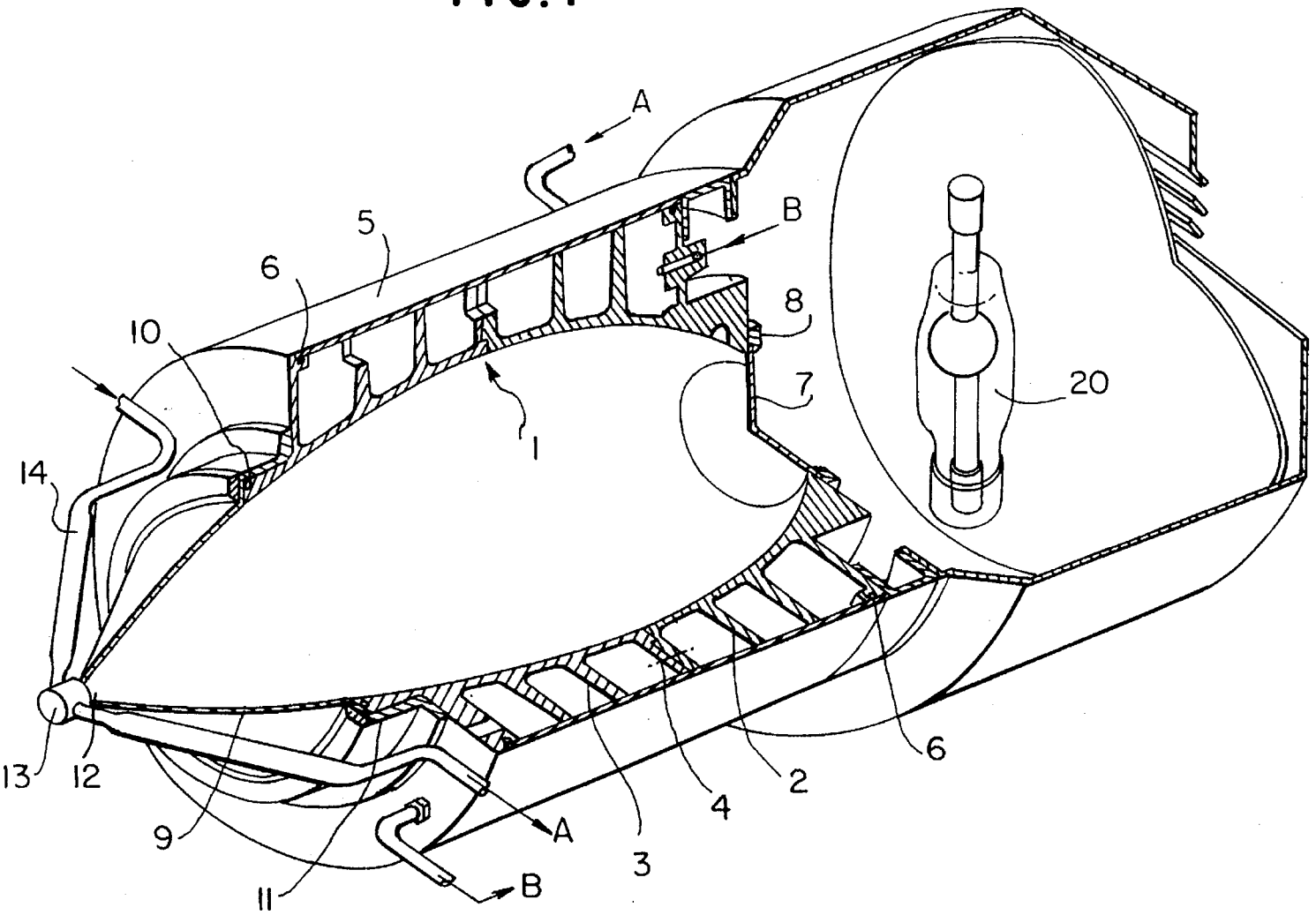
FIG. 1 is a cut-away view of the fluid optical system.
Figure 2:
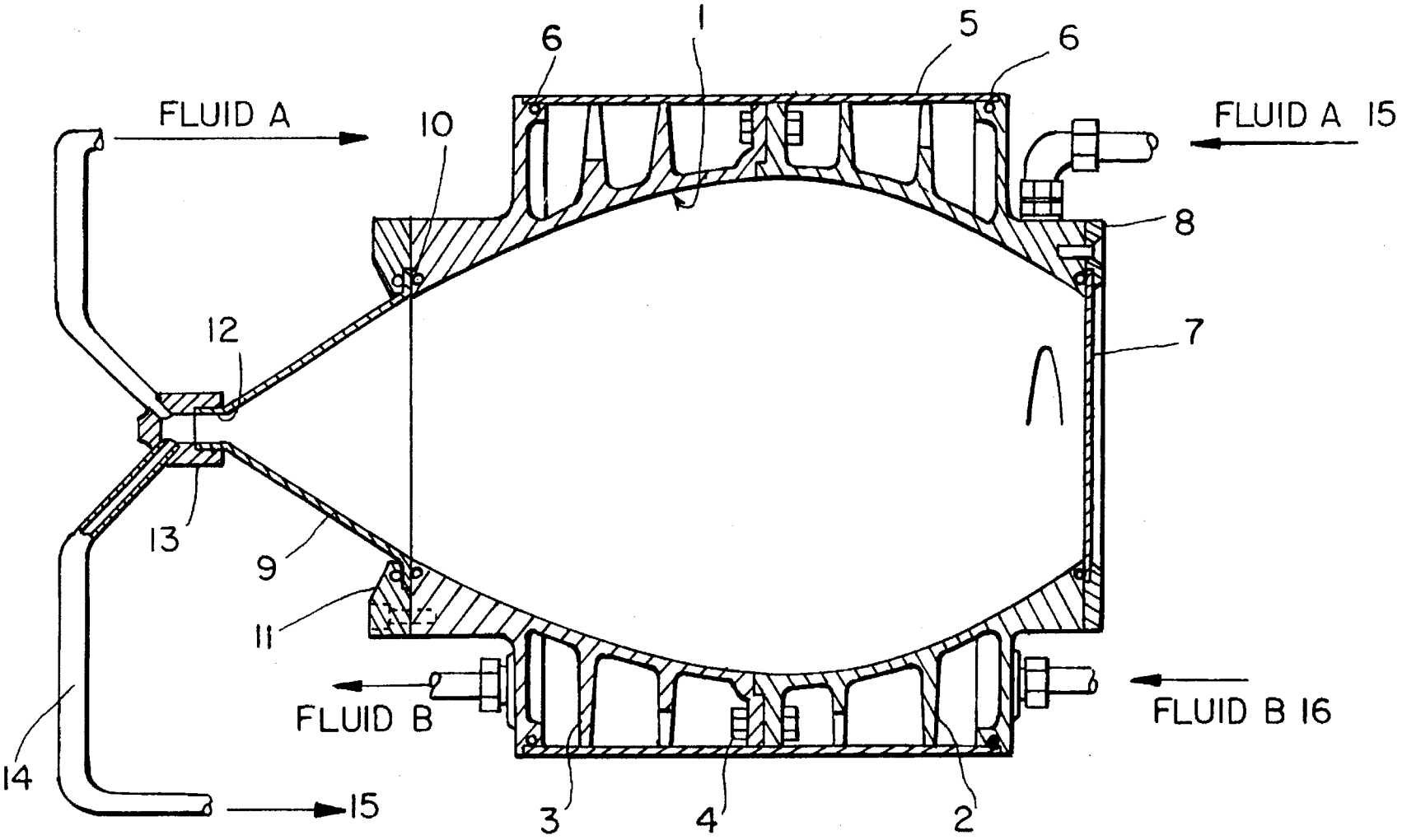
FIG. 2 shows a longitudinal section of the fluid optical system.

FIGS. 1 and 2 show that the device is made of the following numbered elements:

The internal shape (1) which constitutes the essential part of the fluid optical system. This shape is obtained through the revolution of the arc of a logarithmic spiral.

Its surface is covered with a reflecting chromium-, nickel- or silver-plated layer, or a glass deposit, or any other totally reflective material. This part can be melted under pressure, and made of cast aluminium or cast iron or any other material with a good mechanical and thermic resistance.

The inside geometry must be perfect.

Containers (2) and (3), which support the inside shape, are made of two casings fixed together by a seal and a couple of screws. These casings can serve as an external radiator to drain off excess calories through the forced circulation of a fluid.

External casing containing the coolant fluid.

Waterproof seal.

A planar entrance surface 7 made of a transparent window as illustrated in FIGS. 1 and 2.

Waterproofness is guaranteed by a toric seal. The whole is held together by a screwed flange (8).

The exit cone (9) of the internal shape (1) is made of transparent material such as heat resistance optical glass.

A flange (11) holds the cone and parts (1), (2) and (3) together. A toric seal keeps the whole device waterproof.

The end of the cone (12) holds a draining ring which drains off optical fluid in order to cool it down.

For the whole device to work well, it is necessary to force the circulation of the optical fluid (A)—e.g., water. The fluid must enter the optical system tangentially to the optical shape, and as close as possible to entrance surface, which must be arranged in such a way that initial circulation be tangential and laminary. Inside the whole optical system, the fluid must have a centripetal rotation movement until it exists through the cone end. The draining ring (13) helps to drain off the optical fluid (A) through a pipe (14), towards a closed-circuit cooling and filtering system. This fluid partly drains off the excess calorific energy created by infrared rays. The draining pipe (14) is flattened in the direction of the luminous flow in order to minimize the distorsion of the outgoing beam.

A closed circuit system consists of a filter, a pump and a heat exchanger. The peripheral radiator's cooling thermic fluid (B)(16) enters on the side of the optical system's entrance surface (which is the warmest side). It exits on the side of the cone end. The whole circuit must be implemented and controlled by a servo system. It will be controlled on the basis of temperature, pressure and flow tests made at strategic points on the cooling circuit. The creation of a very powerful optical projector makes it possible to considerablly increase the brightness and to diversify the applications of such devices.

This types of floodlight is able to project fixed or moving pictures on far away screens (such as clouds or buildings). The floodlight is therefore ideally suited to light and sound displays and large outside shows. It also allows the far away projection of very bright beams of light with a wide angle (about 170°).

It can also be suitably used to light up public building sites and roadworks (such as the construction of dams, bridges or tunnels), or great port installations like Antifer, thus bringing the staff better security. Other applications such as the enlightenment of prestigious sites can also be considered.

It is possible as well, to use these projectors when fog or mist reduce visibility (lighting up of harbors, landing runways or road junctions) by using a different fluid chosen for its properties of transmission or absorption of part of the luminous flow according to its wavelength. In this case, a different fluid will be chosen. The use of thick or solid products with similar optical properties also allows the floodlights to be mounted on flying, floating or rolling objects. The shape can also be used empty, thus only employing the optical properties created by the revolution spiral.

In all the cases, it is necessary to always respect the inside shape of the focusing optical system's volume, whether generated by revolution or not. Lastly, it is also possible to create a solid, monolithic, transparent block like glass or plastic. This block could also focus lightbeams in the same way. The outside shape (useful diopter) of this block must respect the volume of the fluid optic.

It is worth noting the such floodlights produce no heat either in the environment or in the luminous flow.

The optical path of the device is reversible, in that the entrance of the fluid optic can be used as the exit and vice-versa. More specifically, the device is reversible as to the direction of the propagation of an electromagnetic beam that obeys Descartes-Snell's laws; several electromagnetic beam transmitters placed by the entrance surface produced a beam which consists of an organized surface fixed by the exit cone; also, several electromagnetic detectors can be placed by the entrance to simultaneously detect a signal coming from the exit cone and having the same direction.

We claim:

1. A device for focusing all entering light whatever its direction and incidence, said device comprising an optical system having an entrance surface through which the light enters and an exit end through which the light exits as an organized and constant luminous flow, said optical system having a volume with an optical shape generated by a logarithmic spiral so that said focusing occurs for light beams entering said entrance surface from any direction and through any point of said entrance surface;

wherein there flows in the optical shape a fluid which is maintained in forced circulation to form a fluid optical system, and which is forced to enter the optical system tangentially to the optical shape and adjacent to the entrance surface which is arranged so that initial circulation of the fluid is tangential and laminar; and wherein, inside the optical system, the fluid has a centripetal rotation movement until it exits through a cone end of the optical shape, thus draining off calories.

2. Device in accordance with claim 1, characterized by the centripetal movement creating a refraction rate gradient inside the fluid optical system.

3. Device in accordance with claim 2, characterized by the fluid being chosen for its ability to transmit or absorb part of the luminous flow according to its wavelength.

4. Device in accordance with claim 3 wherein said entrance surface is made of a transparent window through which the luminous flow comes in, and wherein said cone end is an exit cone whose shape is a continuation of the optical volume, and made of a transparent material.

5. Device in accordance with claim 3 characterized by the shape being cooled down by an additional thermic fluid having an external radiator.

* * * * *